United States Patent [19]

Voggenreiter et al.

[11] Patent Number: 4,646,822

[45] Date of Patent: Mar. 3, 1987

[54] HEAT EXCHANGER

[75] Inventors: Martin Voggenreiter, Wolfratshausen; Rainer Dietz, Grünwald; Erwin Poloczek, Wolfratshausen, all of Fed. Rep. of Germany

[73] Assignee: Linde Aktiengesellschaft, Wiesbaden, Fed. Rep. of Germany

[21] Appl. No.: 727,024

[22] Filed: Apr. 25, 1985

[30] Foreign Application Priority Data

Apr. 27, 1984 [DE] Fed. Rep. of Germany ..... 3415807

[51] Int. Cl.[4] ..... F28F 3/00

[52] U.S. Cl. ..... 165/166

[58] Field of Search ..... 165/166, 110

[56] References Cited

U.S. PATENT DOCUMENTS

| | | | |
|---|---|---|---|
| 3,559,722 | 2/1971 | Schauls | 165/166 |
| 3,880,231 | 4/1975 | Gauthier | 165/166 |
| 3,895,676 | 7/1975 | Young | 165/166 |
| 3,992,168 | 11/1976 | Toyama et al. | 165/166 X |
| 4,109,710 | 8/1978 | Förster et al. | 165/166 X |
| 4,249,595 | 2/1981 | Butt | 165/166 |
| 4,450,903 | 5/1984 | Butt | 165/166 X |

FOREIGN PATENT DOCUMENTS

| | | | |
|---|---|---|---|
| 1532673 | 11/1978 | United Kingdom | 165/166 |
| 2064748 | 6/1981 | United Kingdom | 165/166 |
| 2127140 | 4/1984 | United Kingdom | 165/166 |

*Primary Examiner*—William R. Cline
*Assistant Examiner*—Peggy A. Neils
*Attorney, Agent, or Firm*—Karl F. Ross; Herbert Dubno

[57] ABSTRACT

A heat exchanger of the type in which spaced apart plates define flow passages between them and alternating flow passages conduct different fluid media in heat exchanging relationship through the plates. One of the fluid media is a mixture of a gas phase into liquid phase and, according to the invention, the mixing device is provided in the passage for the mixture and is in the form of a bar which can brace the two plates flanking it against deformation under pressure. This bar has channels for one of the phases in a duct extending the length of the bar and communicating with the channels through spaced apart openings or orifices or with the passage downstream of the bar for the other phase through such openings or orifices.

6 Claims, 11 Drawing Figures

HEAT EXCHANGER

FIELD OF THE INVENTION

Our present invention relates to a heat exchanger having a plurality of plates defining a plurality of passages in heat exchanging relationship with one another and, specifically, passages for a first fluid medium between an inlet and out outlet therefore and for a second fluid medium which can consist of a mixture of two fluid phases, namely, a gas phase and a liquid phase, and wherein the second passages are provided with mixing means for forming the mixture constituting the second fluid medium which is in heat exchanging relationship indirectly through the plates with the first heat exchange medium.

BACKGROUND OF THE INVENTION

Heat exchangers of the type referred to above are required for a number of processes and generally are formed from stacks of plates which are sealed around their edges with respective bars, each plate defining one or more flow passages for the respective fluid medium. The alternate passages may be traversed by the different fluid media and inlets and outlets are provided on opposite sides of the heat exchanger for the respective fluid media. Neighboring passages are thus traversed by different fluids and respective fluids have correspondingly separate inlet and outlet fittings by means of which the fluids to be subjected to heat exchange are supplied and are removed.

The processes in which such heat exchangers are involved can include, for example, the rectification of natural gas, i.e. the separation of natural gas into its components in a low temperature process. Here specifically a heat exchange is required between a two-phase mixture of a liquid and a gaseous phase and some other fluid.

In all processes in which these are the requirements, there are problems which arise from the need for uniformly distributing the two phases over the entire span of each flow passage and over the number of flow passages.

Particularly when a number of flow passages are to be traversed by the two-phase mixture, a uniform distribution of the two phases to all of these passages is difficult if not impossible with prior art arrangements.

Indeed, we have discovered that when two-phase mixtures are supplied after prior formation by a manifold to a number of such passages, an imbalance between the liquid and gaseous phases in the respective passages almost invariably develops. Several passages or several regions of several passages contain an excess of the gas component while other passages tend to contain or carry an excess of the liquid component. It is possible that these difficulties arise because of the specific gravity or density differences between the two components of the two-phase mixture. The non-uniform distribution of the two phases results in a reduction in the heat exchange efficiency.

Efforts have already been proposed to attempt to ensure uniform distribution of the two phases over the various flow paths of a heat exchanger and reference may be had to U.S. Pat. No. 3,559,722 in this connection.

In this publication the two phases are supplied separately to the heat exchanger and mix only within the heat exchanger. Each phase can thus be fed uniformly to the appropriate number of passages and distributed uniformly over the entire width of each of the flow cross sections to be traversed by the two-phase mixture.

The phases are separated at least initially by a partition. Thereafter, the two phases are mixed and can enter into heat exchange with the other fluid. The mixing device is thus a gap in the partition wall.

With this system it is indeed possible to obtain a relatively effective mixing and uniform distribution of the two phases. However, the presence of a mixing device within the heat exchanger provided with gaps in the partition walls results at a weakening of the structure. Consequently, when one operates with heat exchanging fluids which are under pressure and sometimes under considerable pressure, the heat exchanger cannot be effectively used or must in highly expensive and complex ways be reinforced so as to be able to sustain the high pressures which are employed.

OBJECTS OF THE INVENTION

It is, therefore, the principal object of the present invention to provide a heat exchanger of the aforedescribed type which has a comparatively simple construction and yet can be used in the presence of high pressure levels of the fluids which are to be subjected to heat exchange.

Another object of this invention is to provide a heat exchanger which allows especially uniform mixing and distribution of a two-phase mixture but nevertheless does not suffer from structural weakening.

Still a further object of our invention is to provide a heat exchanger which can be used effectively in the cases previously described, e.g. for the rectification or separation of natural gas and which is able to provide for uniform mixing and distribution of a two-phase mixture and yet can withstand very high pressures.

SUMMARY OF THE INVENTION

These objects are attained, in accordance with the invention, by providing the mixing device in each of the passages of the flow cross section for the second medium, i.e. the medium constituted of gas and liquid phases, as bars which extend substantially over the entire cross section of the respective passages and the full height or width of this cross section, each of the bars being provided in a respective one of the passages and extending the full width of the plates thereof.

The bars are formed with channels extending in the flow direction for one of the two phases and with a throughgoing duct or canal traversed by the other of the two phases, this canal opening either into the channels or into the passage downstream of the bar in a uniform manner across the length thereof.

More specifically, a heat exchanger according to the invention can comprise at least three spaced-apart parallel plates defining between pairs thereof respective flow passages for two fluid media in indirect heat exchanging relationship through one of the plates common to both pairs. In practice, a stack of such plates will be provided with the flow passages for the two fluid media alternating with one or another.

Means forming an inlet on one side of said heat exchanger and an outlet on an opposite side of the heat exchanger communicates with one of the flow passages or groups of flow passages for feeding a first fluid constituting one of the fluid media therethrough, the other of the fluid media being constituted, as previously noted, as a mixture of the gas phase and a liquid phase.

The apparatus thus also includes means forming an inlet for one of these phases communicating with the other of these passages or others of these passages which are assigned to the second medium, at one side of the heat exchanger, while means forming an outlet communicating with the other passage or passages for discharging this second or other fluid medium is provided at an opposite side.

A mixing device is provided in the other passage or other passages for mixing the phases to form the second fluid medium. The mixing device, as noted, comprises a bar disposed between each of the plates defining one of the other passages and extending the full width of these plates, each of the bars fully bridging the gap between the two plates defining the flow cross section for the other fluid medium.

The bar or each bar can be formed with a plurality of channels spaced apart along the length of the bar and extending in a flow direction for the first mentioned phase between the inlet thereof and the outlet for the other medium, and with means forming the duct extending along the bar for the other of the phases, this duct opening into each of the channels or into the other passage downstream of the bar in a uniform manner spaced across the length of the bar.

With the heat exchanger of the invention, therefore, the mixing device actually fills the cross section of the flow passage which is to be traversed by the second phase except possibly for the channels provided for the first of the two phases. In the region of the mixing arrangement, therefore, the plates are braced apart by a bar which may be located at an area of interruption of the fins which may extend in the flow direction generally and act as guides for the flow of the two-phase mixture. The height of the bar is therefore equal to the spacing between the plates defining the respective passage.

The bar is provided with the channels for one of the phases in the flow direction, i.e. perpendicular to the duct running through the bar itself, and by means of which the other phase is distributed uniformly in the mixing chamber formed by the passage downstream of the bar.

The pressure drop generated by the channels ensures a uniform distribution of this phase over the width of the passage. Transverse to the flow direction the duct distributes the second of the two phases uniformly over the length of the bar and thus over the width of the passage since the bar length corresponds to the width of the passage.

The duct is formed with outlet openings or orifices which can open into the channels or into the mixing chamber at the downstream side of the bar. By variation in form, size and number of the channels, the heat exchanger can be optimally modified in accordance with the requirements for heat exchange efficiency, pressure drop flow rate and the like.

The heat exchanger of the invention provides an especially effective mixing of the phases and uniform distribution of the two phases along the flow passage defined by the second group of passages. Because of its bar-like construction, the mixing device does not detrimentally effect the ability of the heat exchanger to withstand high pressures.

In accordance with a preferred embodiment of the present invention, the bar or each bar is soldered to the plates abutting same or flanking same.

Generally speaking plate-type heat exchangers are formed by assembling the plates in mutually parallel relationship and soldering them to sealing bars which act as spacers between the plates along the edges thereof, these spacer bars being interrupted only in the region where communication is required to manifolds forming the inlets and outlets.

It has been found to be advantageous in accordance with the present invention to form the bars constituting the mixing devices as sections of the sealing and spacing bars cut from a length of the stock thereof and therefore having corresponding cross sections and heights or thicknesses. Naturally if the stock forming the lateral sealing and spacing bars is used for this purpose, the sections cut from the stock forming the lateral sealing and spacing bars must be provided with the requisite channels and ducts and outlet openings or orifices.

According to another feature of the invention, the canal itself may be provided with the outlet openings into the channels and/or the mixing chamber downstream of the bar. The outlet openings can thus be formed as bores directly within the mixing bar and drilled from the surface of the bar or from the bottoms of the channels into the canal.

To prevent the openings or orifices from being blocked by hot solder during the soldering of the heat exchanger, the outlet openings can be recessed below the upper or an outer surface of the bar. This is the case where the upper surface is to be soldered, for example, to the overlying plate.

According to another feature of the invention, each bar is assembled from two halves and the duct is provided or defined by the two halves which can be shaped correspondingly.

Each of the two halves can extend over the entire width of the passage and may bridge the entire height of the flow cross section defined between a pair of plates. In this case, each half of the mixing-device bar is constituted by a length of the stock used for the side spacers and seals.

The two halves can be assembled with a gap between them so that this gap constitutes or forms part of the aforementioned duct. Alternatively, the two bar halves can abut one another and can be formed with flanks which are not parallel and thus which define, for example, wedge-cross section ducts. In still another alternative one or both of the bar halves may be formed with a groove which, upon assembly of the two bar halves is closed peripherally to define the duct.

It has also been advantageous in another embodiment of the invention to provide a groove, recess or other formation in the bar forming the mixing device and into which a pipe or tube is set. In this arrangement especially high pressure-stability of the duct is ensured.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
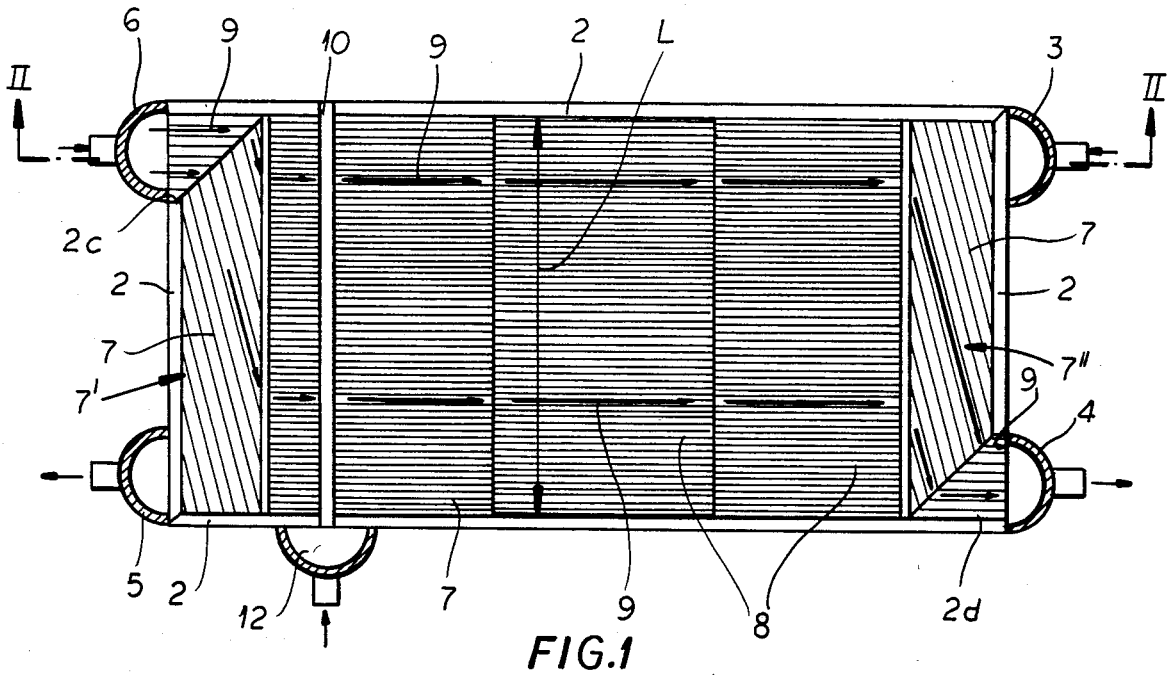
FIG. 1 is a diagrammatic section through a heat exchanger according to the invention taken parallel to the plates thereof but with a plate unsoldered so that the lateral sealing and spacer bars are seen in elevation and the fins have been shown highly diagrammatically as simple lines.

The basic structure of the apparatus of the invention will be described with reference to FIGS. 1 and 2. In the discussion of FIGS. 3 through 10 it will be understood that parts corresponding to those of FIGS. 1 and 2 have been designated with the same reference numerals in a 100, 200, 300, etc. series where the parts perform similar functions but are structurally different.

Figure 2:
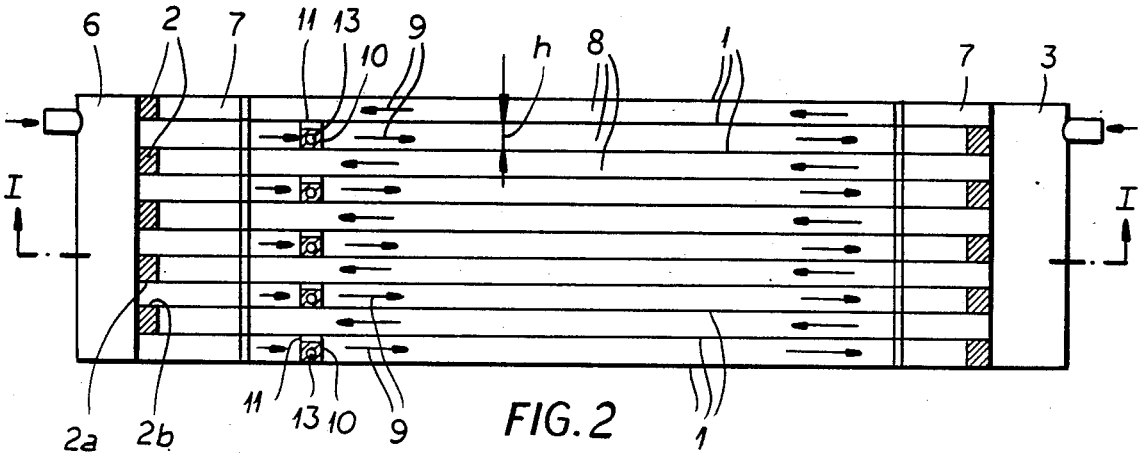
FIG. 2 is a diagrammatic section taken along line II—II of FIG. 1, FIG. 1 representing generally a section along the line I—I of FIG. 2, but wherein the plates delimiting the flow passages have been represented only as single lines since a scale representation in which these plates were shown hatched would require a much larger view rendering the overall heat exchanger construction ununderstandable.

The heat exchanger shown in FIGS. 1 and 2 comprises a stack of substantially planar rectangular plates 1 which define between them respective flow passages for two fluid media. The passages are sealed along their edges by sealing spacer bars 2 which can be seen to have rectangular cross sections.

As can be seen from FIG. 2, the plates are soldered at 2*a* and 2*b* to these sealing bars and sealing bars 2 are likewise soldered to any walls or fittings required to feed fluid to or remove fluid from the flow passages.

At the short end of the rectangular structure, the bars 2 are selectively interrupted to leave openings such as that represented at 2*c* and 2*d* in FIG. 1. For each of the flow passages 8, therefore, two such openings 2*c* and 2*d* are provided at diagonally opposite locations and on opposite sides of the heat exchanger.

The openings of alternate flow passages 8 communicate with semi-cylindrical or semi-tubular manifolds 3, 4, 5, 6 so that, as can be seen in FIG. 1, the upper flow passage 8, counted as the first flow passage, is connected to the manifold 3 and likewise the third, fifth, seventh, and ninth flow passages are also connected to the manifold 3. Correspondingly, the first, third, fifth, seventh and ninth flow passages are connected to the manifold 5. The manifold 3 forming an inlet for these flow passages which conduct the first fluid, i.e. the single-phase fluid, while the manifold 5 serves as the discharge manifold or outlet for this fluid.

Correspondingly, the flow passages which are the second, fourth, sixth, eighth and tenth flow passages counting from the top, are mixing passages and the manifold 4 serves as the outlet while the manifold 6 serves as the common inlet for them. The openings of the alternate passages thus lie opposite diagonal corners on opposite sides of the heat exchanger.

Figure 1A:
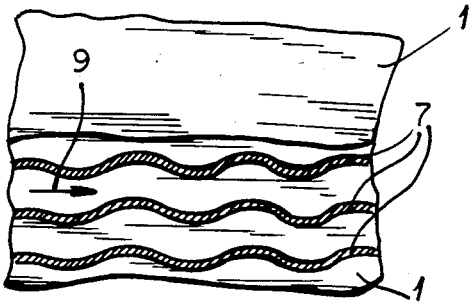
FIG. 1A is a detailed view illustrating a feature of FIG. 1 which is not visible therein.

The flow passages are each formed with distributor lamellae or fins represented at 7 in FIGS. 1 and 2 but best seen in FIG. 1A where the lamellae 7 are shown to be corrugated in configuration and to subdivide the flow passage 8 into a multiplicity of undulating paths running generally in the direction of the arrow 9. The corrugated fins or lamellae 7 can be soldered to the plates 1 above and below each of the lamellae.

Sets of lamellae 7 are provided at an inclined configuration at zones 7′ and 7″ at opposite ends of the apparatus to distribute the flow from an inlet manifold 6 or 3 and to collect the fluid from the passages and deliver them to an outlet manifold 4 or 8.

As previously noted, the second fluid medium is to be a two-phase liquid/gas mixture and is to traverse the second, fourth, sixth, eighth, and tenth passages, counting from the top in FIG. 2, to subject this two-phase mixture to heat exchange withthe single phase mixture traversing the first, third, fifth, seventh and ninth flow passages.

The two phases are separately supplied to the mixing chambers formed by the flow passages 8 downstream of the respective mixing devices. One of these two phases is supplied by the manifold 6 while the other is supplied by a manifold 12 mounted along one longitudinal side of the heat exchanger as can be seen from FIG. 1. Mixing units 10 in each of the second, fourth, sixth, eighth and tenth flow passages serves to distribute the two phases over the entire width of the passage as represented in FIG. 1, the width of the flow passage corresponding to the length of the mixing unit 10. In FIGS. 1 and 2, the mixing units have been shown only schematically and the specific details of various embodiments of these mixing units can be ascertained from FIGS. 3 through 10.

In all cases, each mixing device 10 comprises at least one solid bar which has a height h corresponding to the spacing of two plates 1 defining the respective flow passage and whose upper and lower surfaces are soldered to these plates. The bar 10 has a length at least equal to the length L represented in FIG. 1 which also represents the width of the flow cross section.

The bar is located between two plates within the flow passage to be traversed by the second medium and is provided with a multiplicity of channels which have not been shown in FIG. 1 to avoid confusion but which have been represented at 11 in FIG. 2. These channels are uniformly distributed over the length of the bar but extend transversely to the length in the flow direction represented by the arrows 9. In addition, each bar is provided with a duct 13 communicating with the manifold 12 which serves to distribute the second phase to the bars. The bars each have openings which communicate either with the channels 11 or with the chambers downstream of these bars formed by the passages 8. The duct 13 also extends the full width of the passage, i.e. a length at least equal to the length L.

The second phase, preferably the liquid phase, is thus forced into the first phase either directly in each channel 11 or immediately downstream of the bar 10. At the openings, the two phases thoroughly mix and proceed as a two-phase mixture down the remainder of the flow passage in heat exchange with the first mentioned fluid.

In dependence upon the ratio of the gas phase to the liquid phase, either the gas or the liquid phase may be fed by the manifold 12 while the other is fed by the manifold 6.

It will be apparent that the principles of this invention are applicable to more than two flow cross sections and heat exchange between more than two fluid media. Furthermore, both fluid media may be two-phase fluid media in which case mixing devices such as those shown at 10 would be provided on the right hand side of the flow cross sections represented by the first, third, fifth, seventh and ninth passages as previously described.

Figure 3:
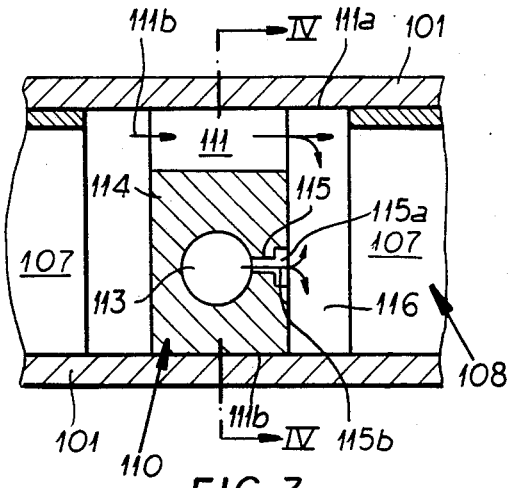
FIGS. 3 through 10 are various sectional views illustrating different embodiments of the mixing means of the invention, FIG. 3 being a section taken along the line III—III of FIG. 4, FIG. 4 being a section taken along the line IV—IV of FIG. 3, and FIG. 10 being a section taken along the line X—X of FIG. 9.
Figure 4:
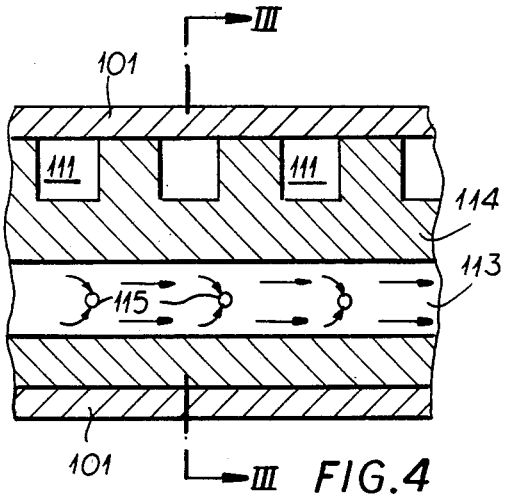

In FIGS. 3 and 4, we have shown a first embodiment of the mixing device here represented at 110 and disposed in a gap 116 between the lamellae or fins 107 between the plates 101. In this case, the channels 111 can be seen to be rectangular cross section grooves formed in the upper surface of the bar 114 while the duct 113 extends the length of this bar. The surfaces 111*a* and 111*b* may be soldered to the plate 101 and the duct 113 may have narrow orifices 115 opening into outlets 115*a* which communicate with the passage 108 upstream of the bar, i.e. with the mixing chamber. The first phase traverses, as represented by the arrow 111*b*, the channels 111 and mixes with the second phase which flows in the direction of the arrows 115*b*. Here the duct 113 is formed directly in the bar 114. The orifices 115 can be seen to be counter-sunk below the vertical surface at which they open to prevent blockage from solder which may flow down along this surface. It will be apparent that the form, the number, the sizes, the locations, of the channels 111 and the outlet orifices 115 can be selected to satisfy the respective fluid flow requirements.

Figure 5:
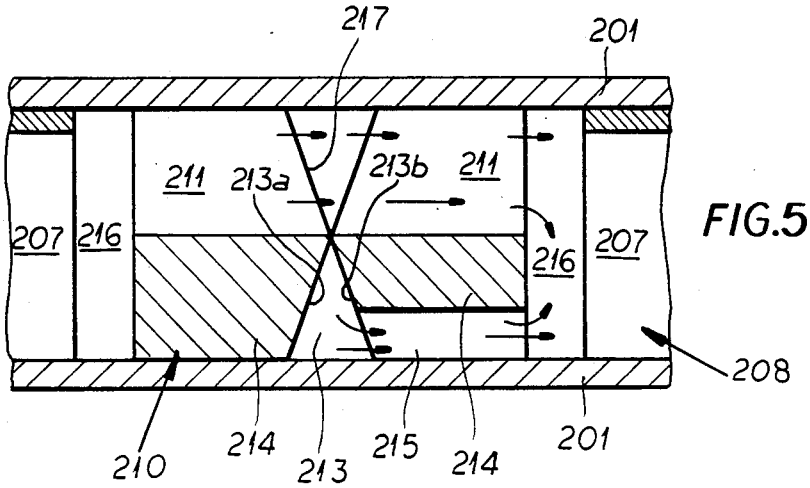

In FIG. 5, we have shown an embodiment of the invention in which two bars 214 are provided to form the mixing device 210. The bars are provided with channels 211 in the manner previously described and are soldered to the plates 201. An interruption 216 can be provided in the lamellae 207 which form the guides for the second fluid medium in the manner previously described. In this embodiment, however, the duct 213 is defined by inclined flanks 213*a*, 213*b* which are formed in the bars 214 which may be symmetrical in this respect, the duct 213 opening via channels 215 into the passage 208 downstream of the bar.

One of the phases of a two-phase mixture is thus fed in the previously described manner through the channels 211 while the other fluid is supplied by the duct 213 and mixes with the first phase in the passage 208. The channels 211 in the two bars 214 need not be aligned as shown but can be offset from one another, the duct 217 between the two bars acting to further ensure uniform distribution of the first phase in its flow across the width of the passage.

The passages 215 can be parallel to the channels 211 or inclined thereto at an angle.

Figure 6:
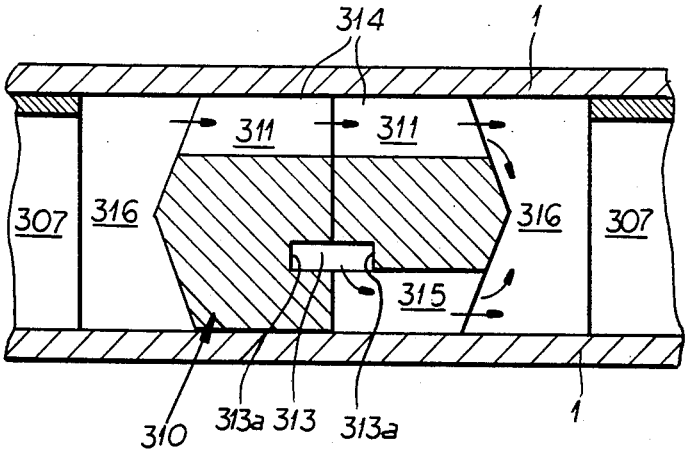

In the embodiment of FIG. 6, the mixing device 310 is again formed by two bars 314 each formed with the channels 311 in the manner previously described. Here, however, the two bars 314 are provided with longitudinal grooves 313*a* which register with one another to form the duct 313, the latter opening into passages 315 in the downstream bar, the passages 315 communicating with the space 316 left downstream of this bar in the array of lamellae 307. The passages 15, 115, 215 and 315 etc. are distributed uniformly over the length of the bar at least at its downstream side to ensure uniform distribution of the second phase in the passage.

Figure 7:
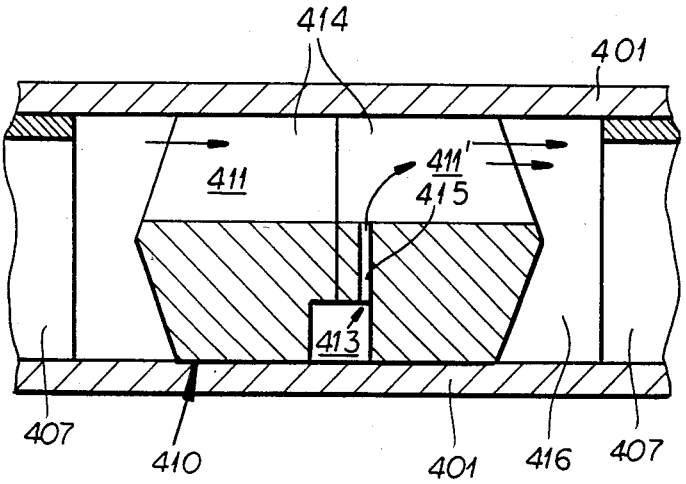

The embodiment of FIG. 7 is generally similar to that of FIG. 6 in that the mixing device 410 comprises a pair of bars 414 which are placed against one another and define a duct 413 between them. Here, however, the duct 413 opens via passages 415 upwardly into the channel 411' of the downstream side. The bars 414 are thus provided with channels 411, 411' which communicate with one another and serve to conduct the first of the two phases in the manner previously described, the interruption in the lamellae being represented at 416 and the lamellae themselves being shown at 407 between the plates 401.

The mixtures here formed in the downstream channels 411' uniformly across the width of the flow passage.

A modified version of the embodiment of FIG. 7 will utilize a single bar of the shape and configuration of the two bars 414 shown, provided with the duct 413 in the form of a groove.

Figure 8:
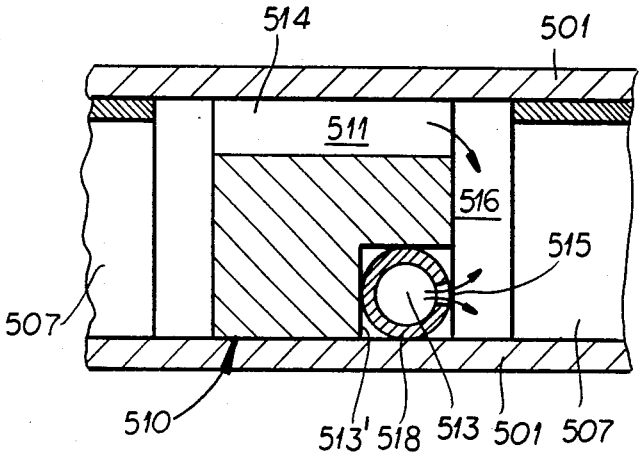

FIG. 8 shows still another embodiment of the invention wherein between the two plates 501, the mixing device 510 comprises a single bar 514 formed with the channels 511 as previously described in connection with FIGS. 3 and 4, for example. Here, however, a recess 513' is formed in the downstream side of this bar and accommodates a duct 518 which is set into this recess and is provided with a multiplicity of orifices 515 open to the upstream side and forming the duct 513. The duct 513, of course, communicates with the manifold as represented at 12 in FIG. 1. In this embodiment as well, the lamellae have been represented as 507 and the interruption in the lamellae at 516.

Figure 9:
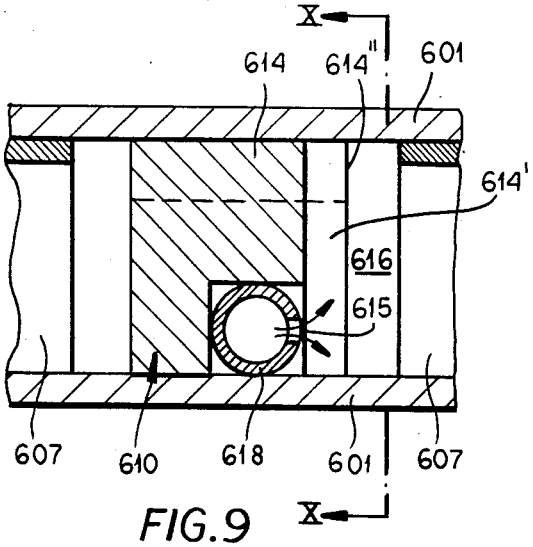
Figure 10:
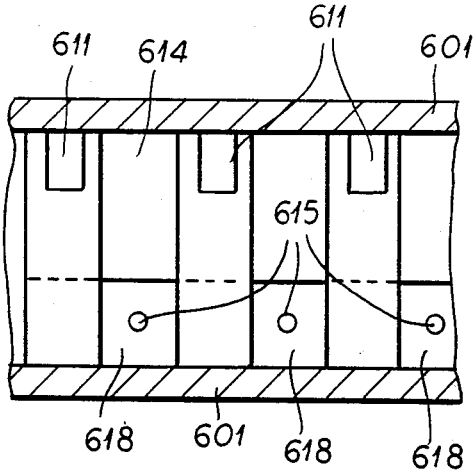

FIGS. 9 and 10 show yet another modification of the configuration of the mixing means 610 between the plates 601. Here the single bar 614 is grooved at 614' at its downstream side so that the pipe 618 and the orifices 615 are set back from the downstream face 614''. The orifices 615 are here axially offset from the channel 611. Otherwise the apparatus shown in FIGS. 9 and 10 operates in the manner described in connection with FIG. 8.

We claim:

1. A heat exchanger comprising:

at least three-spaced apart parallel plates defining between pairs thereof respective flow passages for two fluid media in indirect heat exchange relationship through one of said plates common to both pairs;

means forming an inlet on one side of said heat exchanger and an outlet on an opposite side of said heat exchanger communicating with one of said flow passages for feeding a first fluid constituting one of said fluid media therethrough, the other of said fluid media being constituted of a mixture of a gas phase and a liquid phase;

means forming na inlet for one of said phases communicating with the other of said passages at one side of said heat ecchanger and an outlet communicating with said other passage for discharging said other of said fluid media; and a mixing device in said other of said passages for mixing said phases to form said other of said fluid media, said mixing device comprising a bar disposed between the plates defining said other passage and extending at least approximately over the width of the cross section thereof, said bar extending the full height of the space between the plates defining said other passage and bracing them against pressure, while being formed with:

a plurality of transverse grooves open toward one of said plates braced apart by said bar and defining respective channels spaced apart along the length of said bar and extending in a flow direction for said one of said phases between an inlet thereof and said outlet for said other medium, and a longitudinal groove being closed by the other plate braced by said bar and defining therewith a duct for the other of said phases extending along said bar and opening into said other passage downstream of said bar at spaced locations along said bar formed with further transverse grooves opening toward said other plate braced by said bar to define branches opening into said other passage and, wherein said channels open into an upwardly divergent V-cross section groove extending over the length of said bar and opening toward said one of said plates braced by said bar to interconnect said channels, the longitudinal groove defining said duct being of V-section shape widening through said other plate braced by said bar.

2. The heat exchanger defined in claim 1 wherein said bar is soldered to the said plates flanking same.

3. The heat exchanger defined in claim 1 wherein said bar comprises a section of bar stock, said bar stock constituting spacer and sealing bars between said plates around the periphery of aid heat exchanger.

4. The heat exchanger defined in claim 1 wherein each of said bars is assembled from two bar halves and said duct is formed by a gap between said bar halves.

5. The heat exchanger defined in claim 1 wherein said duct is supplied with said liquid phase.

6. A heat exchanger comprising:

at least three-spaced apart parallel plates defining between pairs thereof respective flow passages for two fluid media in indirect heat exchange relationship through one of said plates common to both pairs;

means forming an inlet on one side of said heat exchanger and an outlet on an opposite side of said heat exchanger communicating with one of said flow passages for feeding a first fluid constituting one of said fluid media therethrough, the other of said fluid media being constituted of a mixture of a gas phase and a liquid phase;

means forming an inlet for one of said phases communicating with the other of said passages at one side of said heat exchanger and an outlet communicating with said other passage for discharging said other of said fluid media; and a mixing device in said other of said passages for mixing said phases to form said other of said fluid media, said mixing device comprising a bar disposed between the plates defining said other passage and extending at least approximately over the width of the cross section thereof, said bar extending the full height of the space between the plates defining said other passage and bracing them agazinst pressure, while being formed with:

a plurality of transverse grooves open toward one of said plates braced apart by said bar and defining respective channels spaced apart along the length of said bar and extending in a flow direction for said one of said phases between an inlet thereof and said outlet for said other medium, and a longitudinal groove being closed by the other plate braced by said bar and defining therewith a duct for the other of said phases extending along said bar and opening into said other passage downstream of said bar at spaced locations along said bar formed with transverse branches opening into said other passage.

* * * * *